United States Patent [19]

McGlew et al.

[11] Patent Number: 4,841,901

[45] Date of Patent: Jun. 27, 1989

[54] LIFE BOAT SUPPORT STRUCTURE

[76] Inventors: John J. McGlew; John J. McGlew, Jr., both of Box 823 (E. Lake Rd.), Tuxedo Park, N.Y. 10987

[21] Appl. No.: 486,098

[22] Filed: Apr. 18, 1983

Related U.S. Application Data

[62] Division of Ser. No. 268,160, May 29, 1981, Pat. No. 4,395,967.

[51] Int. Cl.[4] ..... B63B 23/10

[52] U.S. Cl. ..... 114/370; 114/371; 114/373

[58] Field of Search ..... 114/369–374, 114/365, 368; 414/4

[56] References Cited

U.S. PATENT DOCUMENTS

| | | | |
|---|---|---|---|
| 1,746,109 | 2/1930 | Edwards | 114/370 |
| 2,030,136 | 2/1936 | Carr | 114/370 |
| 4,395,967 | 8/1983 | McGlew et al. | 114/373 |

FOREIGN PATENT DOCUMENTS

| | | | |
|---|---|---|---|
| 156340 | 8/1978 | Netherlands | 414/4 |
| 1148365 | 4/1969 | United Kingdom . | |

*Primary Examiner*—Sherman D. Basinger
*Assistant Examiner*—Thomas J. Brahan
*Attorney, Agent, or Firm*—McGlew & Tuttle

[57] ABSTRACT

A support structure for devices particularly life boats and similar apparatus which is weight operated comprises a plurality of support members, each or some of which may be telescopic which are pivotally interconnected adjacent their associated interconnected ends. Each successive upper one of a pair of such members is pivotal relative to the next adjacent lowermost one about a substantially horizontal axis. The pivoting is controlled by a control mechanism which is operated from a fluid pressure source produced by the weight of the elements upon each other. The control mechanism includes means for controlling the amount of tilt of each upper element relative to an adjacent lower element and for the control of the precise angularity of the two elements relative to each other during the pivotal movement. The construction is such that a life boat may be supported in either a lower or an elevated position on a large ship and the individual support members may be articulated relative to each other so as to pivot the boat outwardly away from the vessel or ship in any manner which is desired. Thus if the ship is on an even keel some of the support members may be held without pivoting and merely one or two of them pivoted to lower the boat to a position in which it contacts the water line. In those cases in which it is desired that the boat be swung outwardly a large amount away from the vessel before it is pivoted downwardly then only the lowermost two elements are pivoted relative to each other, for example. The feature of the construction is that the weight of the life boat itself will cause operation of the controls for the pivoting and for the control of the positioning of each element relative to each other during the proper lowering of the boat into the water.

9 Claims, 4 Drawing Sheets

Fig. 3
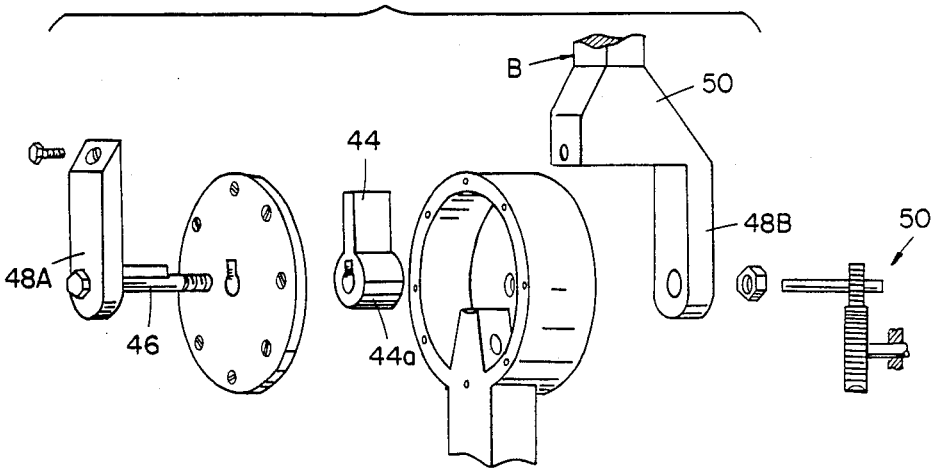
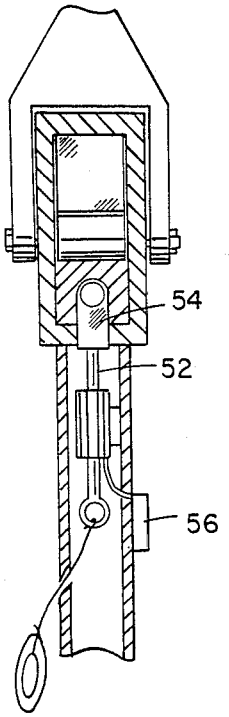
Fig. 4
Fig. 5
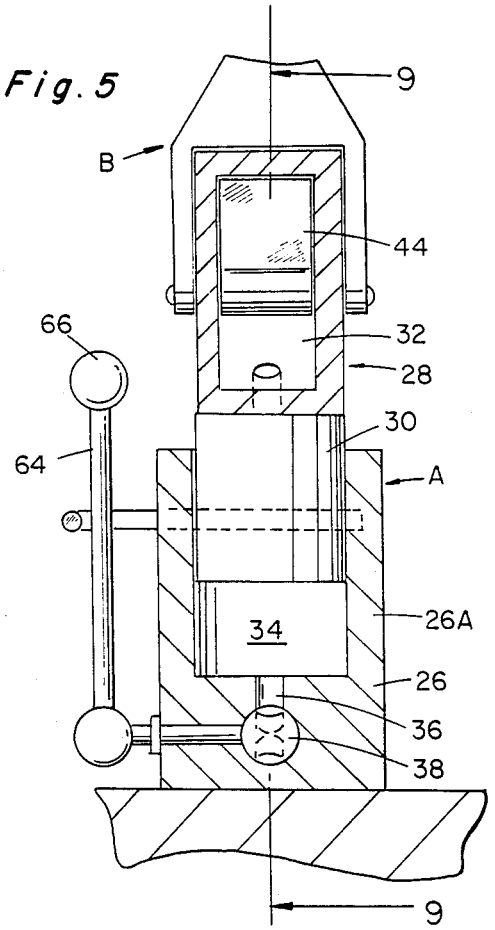

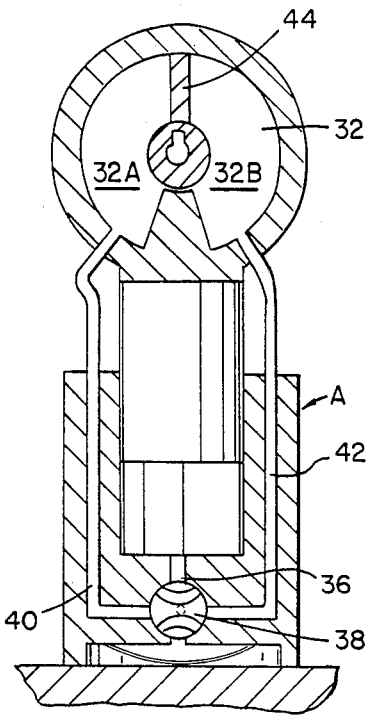
Fig. 9
Fig. 10
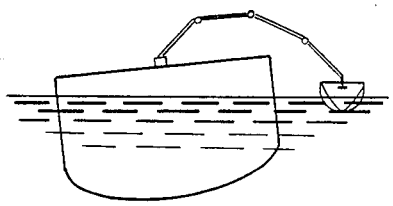
Fig. 11
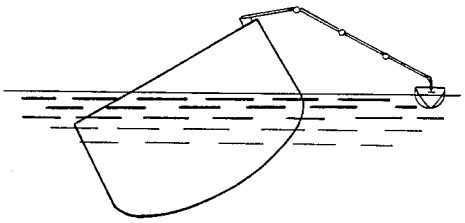
Fig. 12
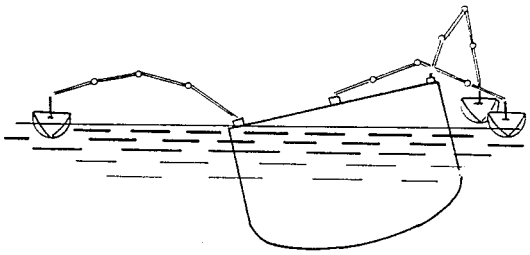
Fig. 13
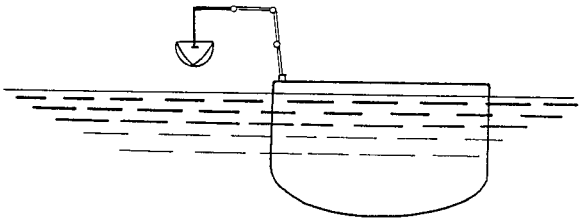

LIFE BOAT SUPPORT STRUCTURE

This is a division of application Ser. No. 268,160, filed May 29, 1981, now U.S. Pat. No. 4,395,967.

FIELD AND BACKGROUND OF THE INVENTION

This invention relates in general to the construction of support devices for supporting elements at an elevation so that they may be lowered downwardly to a lower elevation and particularly, a support structure for life boats which is operable independently of any source of power.

There have been many instances in which life boats could not be launched from vessels because the davit mechanism for lowering the boat could not operate to present the boat outwardly away from a tilted side of the ship or far enough away from a ship which is in the stage of sinking, or at a precise location away from a ship which is the stage of sinking or at a precise location away from any falling debris or fire or wreckage. Known mechanisms which can be lowered by the power of the weight of the lift boat itself in some instances are still such that they operate only to lower the life boat downwardly directly alongside a side of the larger vessel carrying the boat. This means that in many instances in which the large ship is sinking, there are either obstacles in the path of lowering the boat or there is a danger that the lines will become fouled due to the large tilt of the ship or become endangered by some other reason due to the fact that the boat cannot be precisely positioned in water relative to the larger ship.

SUMMARY OF THE INVENTION

In accordance with the invention there is provided a life boat structure which is made up of a plurality of support elements or members which are pivotally interconnected adjacent their associated interconnected ends so that adjacent upper and lower pairs of the elements may be pivoted relative to each other about a substantially horizontal axis. A control mechanism is provided which is powered by the weight of the elements which support the life boat or by the weight of the life boat itself for initiating a pivot of the elements relative to each other in one direction of rotation or the other and for controlling the amount of pivots so that the elements will accurately position a boat either close to the side or far away from the associated ship.

In accordance with a feature of the invention, the support elements advantageously include a lowermost support element with a control mechanism which is operated by the weight of the next uppermost element in an associated cylindrical portion of the lowermost element to generate a fluid pressure which is used to control the rotation or pivot of the next uppermost element relative to the lowermost element. Thus for example, in some instances it may be desirable to pivot the boat in one direction toward the outside of the ship when the ship is oriented in a particular manner in the sea, but it may be more advantageous to pivot it in another direction on some other occasions. The control mechanism makes it possible to control the initial pivot of each of the plurality of these elements so that the eventual lowering of the boat into the water will be at a precise location from the location of the support members. For this purpose the invention envisions the use of a chart or scale on each boat davit showing which element should be pivoted and the degree of angular pivot of each one in order to achieve a launching of the life boat at a desirable location. This information may be stored on the life boat support in the form of a chart indicating what pivots of each individual support elements are necessary to achieve the desired life boat launching, and could include information for example, as to distance that the life boat would be launched outwardly from the associated lowermost support member and from the side of the vessel. This information could be programmed into a control element which will permit the desired rotation of each of the support members located above the lowermost member.

In order that each of the pairs of support members which are articulated together are provided with a control both for initiating the initial direction of rotation and a further control for controlling the total amount of rotation that the upper one will make relative to the lower one, each successive pair of support elements is provided with such a rotational control and fluid pressure operated connection thereto for effecting such control. Alternatively each element may have its own separate control which may be remotely operated. In the preferred arrangement all of the elements may be locked in a vertical or upstanding position by means of a suitable pin which may be removed whenever the life boat is to be employed and lowered. Such a control may be actuated, for example, whenever any additional weight is placed in a life boat as for example when some of the personnel on the vessel enter into it.

In one form of execution each upper member is articulated to a next lowermost member on a shaft containing an impeller which is held in position by fluid pressure so that it and the associated member is held at a proper angle relative to the next adjacent lower member. Upon the manipulation of a control such as a hand lever the pressure in the portion of the lwoer member which defines a pressure chamber may be switched so that pivoting will be effected in a desired direction of rotation and also to a desired angle of rotation. A similar mechanism may be arranged on each pair of elements or the controls may be a single control for all of the elements located in one central station, for example, adjacent the lowermost element.

Accordingly, it is an object of the invention to provide a support structure particularly for the life boats, which comprise a plurality of support members which are pivotally interconnected adjacent their associated interconnected ends so that each adjacent upper and lower members of the pair are pivotal relative to each other and to the next adjacent lower or upper member about a horizontal axis, and control menas are connected between the adjacent members for controlling the rotational direction and amount of rotation in each upper one of said members relative to the next adjacent lower one.

A further object of the invention is to provide a support structure for life boats which permits the lowering of a life boat outwardly and downwardly at any desired angle and spacing from the associated ship and using the weight of the life boat to effect the controlled movement in an manner such that the life boat may be accurately positioned alongside the ship.

A further object of the invention is to provide a life boat support structure which may position a life boat either close to a ship's deck or at an elevated position in respect thereto which is made of a plurality of support elements which may be separately rotatably pivoted to one side of the other of a ship for the purpose of positioning a life boat in a water alongside the ship either directly adjacent the ship or at a selected space location outwardly therefrom.

A further object of the invention is to provide a support structure particularly for life boats which is simple in design, rugged in construction and economical to manufacture.

The various features of novelty which charcterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 3 is an exploded view of a pivot and angular positional control mechanism constructed in accordance with the invention;

FIG. 4 is a section taken along the line 4—4 of FIG. 1;

FIG. 5 is a section taken along the line 5—5 of FIG. 1;

FIG. 9 is a section taken along the line 9—9 of FIG. 5; and

FIGS. 10, 11, 12 and 13 are schematic sectional views indicating the manner of launching the life boat from the support structures constructed in accordance with the invention.

DESCRIPTION OF THE PREFERRED EMBODIMENTS

Figure 1:
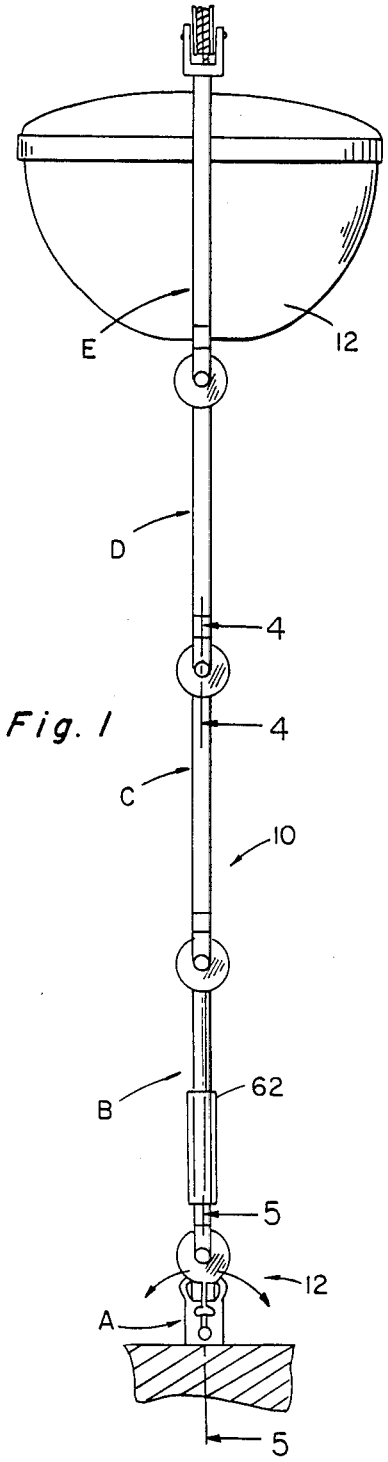
FIG. 1 is a end elevational view partly in section of a ship having a life davit support structure constructed in accordance with the invention.
Figure 2:
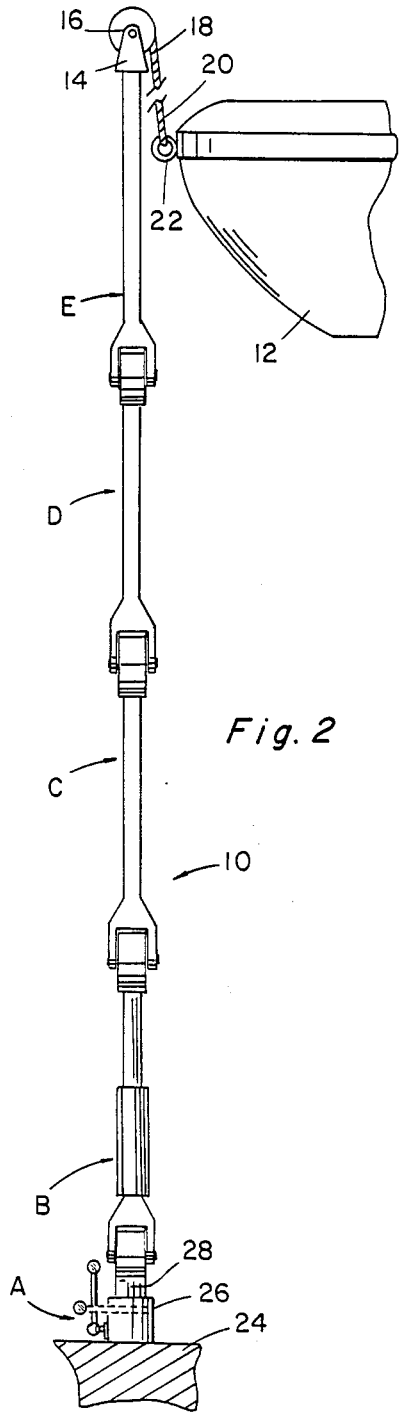
FIG. 2 is a partial side elevational view of the structure shown in FIG. 1.

Referring to the drawings in particular, the invention embodied therein comprises a support structure generally designated 10 particularly for the support of a life boat 12 and which comprises a plurality of support members A, B, C, D, E. In the embodiments shown the uppermost one of the support members E is provided with a lug 14 having a pulley 16 over which a line 18 may be engaged having a suitable block and tackle (not shown) which is connected to a line 20 secured to a connection 22 of the life boat 12. The block and tackle which is not shown may be provided for lowering the boat from the uppermost support element E after it is positioned in a desired orientation with the water or a suitable quick release may be provided for the life boat at the location of its upper end instead of the lug 14 if so desired.

In accordance with the invention each of the support members A, B, C, D, E is provided with a lower end which may be either articulated to the next adjacent member or in the case of the support member A might be anchored or articulated to a deck or similar structure 24. In the embodiment illustrated the lowermost support member A comprises a tubular member 26 which in anchored to the deck 24. The member A includes another rod-like portion 28 having a piston part 30 which rides in a cylinder part **26*a* of the first part 26. Part 28 also includes an upper end defining a pressure chamber 32**.

In accordance with the invention it is desirable to control both the direction of pivotal rotation of a next higher member such as the member B in respect to the adjacent next lower member A. For this purpose a fluid pressure source which is provided by fluid pressure in a cylinder space 34 is used to determine which way the member B will pivot in respect to the member A and thus determine whether life boat 12 will be shifted in either a clockwise direction or a counter clockwise direction. The pressure in the cylinder space 34 is produced by the weight of the member B on the member A and the piston portion 30 of the member B causes a fluid under pressure to flow from the cylinder space 34 to a conduit 36 having a control valve 38 therein which is shown in FIGS. 5 and 9 may be adjusted to permit flow through either one of the conduits 40 or 42 which communicate with respective sides of a piston or vane member 44 which rides in the pressure space 32. The vane member 44 defines the pressure space 32 into separate pressure chambers **32*a* and 32*b* and the pressure in these chambers determines the position of the vane member 44. The valve 38 may also provide for the leading of pressure from the lines 40 or 42 to the opposite area. Vane member 44 has a hub portion 44*a* which is secured on a shaft 46 for rotation therewith. Shaft 46 is connected through arm portions 48*a* and 48*b* of a bifurcated end 50 of the member generally designated B. Thus since the vane member 44 is secured to the member B, rotation of the vane member reflects a similar rotation of the member B and its accurate tilting position. A feature of the construction is that the member B may be initially tilted relative to its next lowest member by an amount which may be accurately controlled by the positioning of the vane member 44 which in turn may be controlled by varying the pressure in respect to chambers 32*a* and 32*b* to aid in the initial rotational movement in a selected direction and then the holding of the members at the relative angle in respect to each other at a predetermined end position. In some instances it is also preferable to drive the shaft 46 through a gearing mechanism generally designated 50 so as to affect the control positioning of the vane member 44 and hence of the arm member 50** relative to the member A or to hold it in a selected angular position once it has moved to an end position. Thus the relative position of each of the links A-B; B-C; C-D; D-E relative to each other may be accurately controlled in respect to angular position relative to each other as well as direction of rotation relative to each other. In addition, the shifting of one member relative to the other may occur up to a certain predetermined limit which may be easily set by the drive mechanism or by the fluid pressure or by some other stopping means to stop the rotation of one support member relative to the other.

In the upright position of the support 10 the members A, B, C, D, E may be held upright for example, by a locking pin 52 which may be engaged in a holding recess 54 when the davit is in a fixed position and prior to any life boat usage. These pins may be pulled out either electrically by an electrical control switch 56 so as to immediately actuate all the members to initially permit them to be shifted or pivoted, each one in respect to the next adjacent one, for the purpose of launching a life boat.

Figure 6:
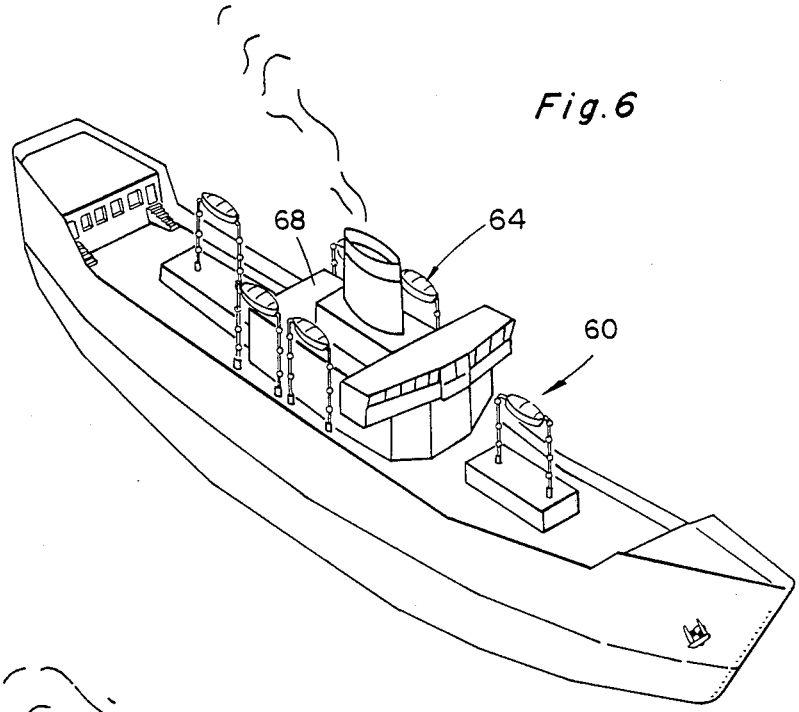
FIG. 6 is a forward top perspective view of a vessel having a life davit system constructed in accordance with the invention.

It should be appreciated that only the lowermost two members A and B have been indicated as containing the mechanism which provides means for initially pivotally rotating one of the members relative to the other in an initial rotational direction and also provide means for setting the member at a desired angle in an end position for the purpose of lowering a life boat; but each one of the pairs of members may have such a control mechanism therebetween so that the support structure may be shifted from the upright or stowage position or seagoing position as shown by the vessel in FIG. 6 or, to one of the launching positions for example as shown in FIGS. 7, 8 and 10 to 13.

Figure 7:
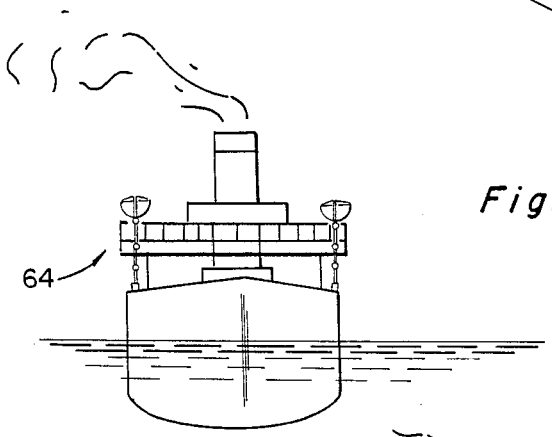
FIG. 7 is a front elevational view of the vessel shown in FIG. 6.
Figure 8:
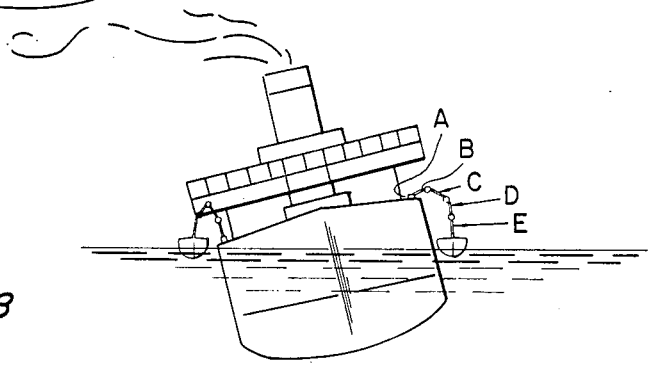
FIG. 8 is a view of the vessel shown in FIG. 6 with a starboard list.

In FIGS. 6, 7 and 8 the life boats are shown as being held on support structures 10 at each end and at an elevation which in many instances is high above the associated deck. In respect to the life boat support structure generally designated 60 shown near the bow of the vessel in FIG. 6, it should be appreciated that each of the support elements advantageously are made up of one or more telescopic members which for example, may include a central cylinder 62 as shown with the element B to which the end elements may be retracted. In addition the lowermost element A may be mounted so that a portion is in a receiving cylinder which may be returned well into the deck. In some cases, however, it may be expedient to allow the boat such as the mounting 60 to remain at an elevated level and to provide a superstructure which may permit the passengers to gain access to the boat by climbing a ladder or some other structure located alongside of it. The life boat structure assemblies 64 shown toward the mid-ship portion of the vessel are advantageously at level such that the life boats will be supported directly adjacent a deck 68 so that access to the boats will be easy.

As shown in FIGS. 7, 8, and 10, 11, 12 and 13 it is possible to pivot the support elements so that by controlling of the angle between the members A and B, B and C, C and D, and D and E it is possible to launch the lifeboat either closely alongside the vessel or as shown in FIG. 8 for example, or removed from the side of the vessel as shown in FIGS. 10, 11 and 12. The arrangement is such that any desired lowering of the boat may be accomplished to position the life boat either directly adjacent the side of the vessel which may be sinking or at a spaced location outwardly from the vessel. In this way it is possible to launch over areas which may contain damaged portions of the vessel or burning wreckage in the sea. In addition it is possible to launch the life boat far away from the side of the vessel if necessary or even close to the side of the vessel in those cases where it is desirable.

The programming for the members A, B, C, D and E and their pivoting movement may be effected by simple remote control station located on the life boat itself and preset or the presetting may be effected at the lowermost member, for example the member A by a suitable control panel which will both release each element so that it may pivot relative to the other or lock them together so that they do not pivot relative to each other and in addition the amount of such pivoting movement may be easily controlled. All of this may be accomplished by charts which would show the position of the life boat relative to the vessel and how to actuate the control so as to achieve the launching of the life boat to position it is respect to the vessel and in accordance with the charts indicated.

In the drawings the simple control member 64 shown as having a knob or handle 66 which may be shifted so as to vary the valve 38 and hence the pressurizing of the space 32 and thus the positioning of the vane member 44, all as shown in FIGS. 3 and 5 and 9. Of course it would be possible to use either electrical, hydraulic or direct mechanical elements 20 effect such control and shifting. It would appear that the most desirable case is to be able to launch each boat so as to position it as desired by merely mechanically actuating each of the members A, B, C, D and E so as to position the boat as desired in the water using only the force or the weight of the boat itself to affect the positioning and the changes of the linkage elements.

While specific embodiments of the invention have been shown and described in detail to illustrate the application of the principles of the invention, it will be understood that the invention may be embodied otherwise without departing from such principles.

What is claimed is:

1. A method of launching a lifeboat supported on the uppermost one of a plurality of support members which includes a lowermost one pivotally mounted over the deck of a ship and a plurality of other support members extending upwardly from the lowermost one and being pivotally interconnected together, comprising applying a force to pivot selected ones of any one of said support members relative to the others while blocking the pivotal connections of the others to maintain a rigid interconnection of said others and so as to control the amount of lowering of the boat which is thereby effected as well as how much the boat will move outwardly of the lowermost support member.

2. A method according to claim 1, wherein there are at least two support members pivotally interconnected located above said lowermost one wherein the one above the lowermost one is pivoted substantially to a horizontal position so as to bring the one above the lowermost one and the one above it into a substantially horizontally extending outward position in which the boat will be moved outwardly furthermost from the lowermost support member.

3. A member according to claim 1, wherein there are at least three support members above said lowermost support member all pivotally interconnected wherein the support member above the lowermost one and the next adjacent one and the next adjacent one above it are maintained rigid and they are pivoted together about the lowermost one in an outward direction to bring the boat the full length of the three support members above the lowermost one outwardly from the lowermost one.

4. A method according to claim 1, wherein the weight of the support members is used to provide a shifting force and the support members above the lowermost one are swung in a selected direction in response to the application of the force.

5. A method of launching a lifeboat which is supported on a support member which is pivotally supported on a plurality of additional vertically superposed support members and which support members are mounted on a fixed deck and pivotally interconnected at its mounting location and to each other, comprising using the weight of at least one of the support members and the weight of the boat to pressurize a fluid pressure driving source, directing the fluid pressure driving source so as to pivot selected ones of said support members in a selected direction in which the boat is to be launched and by a predetermined amount, controlling the amount of pivoting of each additional support member relative to the next adjacent support member so as to control the amount of vertical lowering of the boat and the amount at which the boat will be shifted outwardly in respect to the sides of the ship on which it is to be launched.

6. A method according to claim 5, wherein each additional support member is arranged substantially vertically upright initially, and in order to lower the boat so that it extends furthermost from the side of the ship the lowermost one and the next adjacent support member are pivoted so that all of the other support members extend substantially horizontally.

7. A method according to claim 5, wherein each additional support is arranged substantially vertically upright initially and wherein in order to lower the boat so that it will be closest to the side a single pair of support members are pivoted relative to each other to drop the support members above the pivotal connection into substantially a vertical position and present the boat closest to the side of the ship.

8. A method of launching a device such as a lifeboat supported on the uppermost one of a plurality of support members which include a lowermost support member pivotally mounted over a fixed base and a plurality of other support members extending upwardly from the lowermost one and being pivotally interconnected together, comprising varying the end position of the device in respect to both its lateral and vertical spacing from the fixed base by applying a force to pivot selected ones of any one of said support members by a selected amount relative to the other of said support members while selectively blocking the pivotal connections of at least one of the others to maintain a rigid interconnection of said at least one of the others at a selected angle relative to each other so as to control the amount of the lowering of the device which is thereby effected as well as how much the device will move outwardly of the lowermost support member.

9. A method according to claim 8, wherein the lateral spacing of the device relative to the lowermost support member is effected by pivoting selected support members to substantially horizontal positions so as to increase the lateral spacing of the device from the lowermost support member.

* * * * *